United States Patent [19]

Kurando et al.

[11] Patent Number: 4,963,939

[45] Date of Patent: Oct. 16, 1990

[54] CARTRIDGE DISCRIMINATING SYSTEM

[75] Inventors: Shigeo Kurando; Yoshinori Makiura; Yutaka Shigemura; Junichi Oura; Eiji Mifune, all of Osaka; Tatsuo Imafuku, Kagoshima; Hiroshi Komata, Hyogo; Mikio Ido, Osaka, all of Japan

[73] Assignee: Mita Industrial Co., Ltd., Osaka, Japan

[21] Appl. No.: 99,118

[22] Filed: Sep. 21, 1987

[30] Foreign Application Priority Data

| | | | |
|---|---|---|---|
| Sep. 24, 1986 | [JP] | Japan | 61-226383 |
| Sep. 27, 1986 | [JP] | Japan | 61-228869 |
| Sep. 27, 1986 | [JP] | Japan | 61-228870 |
| Sep. 27, 1986 | [JP] | Japan | 61-228871 |
| Sep. 30, 1986 | [JP] | Japan | 61-234104 |

[51] Int. Cl.[5] ..... G03G 15/08

[52] U.S. Cl. ..... 355/260; 355/203

[58] Field of Search ..... 355/3 DD, 4, 6, 14 D, 355/209, 245, 246, 260; 222/DIG. 1

[56] References Cited

U.S. PATENT DOCUMENTS

| | | | |
|---|---|---|---|
| 4,611,899 | 9/1986 | Kasamura et al. | 355/3 R X |
| 4,634,258 | 1/1987 | Tanaka et al. | 355/14 D X |
| 4,666,290 | 5/1987 | Yoshiura et al. | 355/14 D |
| 4,768,055 | 8/1988 | Takamatsu et al. | 355/3 DD X |

FOREIGN PATENT DOCUMENTS

| | | | |
|---|---|---|---|
| 61-59364 | 3/1986 | Japan | 355/6 |
| 61-83551 | 4/1986 | Japan | 355/6 |
| 61-132969 | 6/1986 | Japan | 355/4 |
| 61-156165 | 7/1986 | Japan . | |

*Primary Examiner*—Joan H. Pendegrass
*Attorney, Agent, or Firm*—Koda & Androlia

[57] ABSTRACT

The present invention relates to a system for making discriminations between cartridges for housing toners to be equipped on image forming apparatus such as electrostatic copiers, laser beam printers, facsimiles, etc. in which while a cartridge indicating means is provided on a part of a toner housing cartridge, an indication detecting means for detecting the aforementioned cartridge indicating means is provided on the image forming apparatus proper side, so that the suitability of the type or position of the cartridge inserted is detected by detecting the cartridge indicating means by the aforementioned detecting means, when the cartridge has been inserted into the cartridge inserting part of the image forming apparatus proper.

11 Claims, 13 Drawing Sheets

CARTRIDGE DISCRIMINATING SYSTEM

BACKGROUND OF THE INVENTION

1. Field of the Invention

The present invention relates to a system for making discriminations between cartridges for housing toners to be equipped on image forming apparatus such as electrostatic copiers, laser beam printers, facsimiles, etc.

2. Description of the Prior Art

Supplementing toner into an image forming apparatus such as aforementioned is done in many cases with a cartridge housing toners therein (hereinafter merely referred to as cartridge) loaded in a cartridge inserting part of the image forming apparatus.

Such a cartridge is sealed on its toner supplementing port with a flexible sheet folded in two plies. Accordingly, when supplementing the toner, this cartridge is loaded in the cartridge inserting part such as a toner hopper, etc., on the developing device side. Thereafter, the toner supplementing port is unsealed by stripping off the aforementioned flexible sheet by pulling its turned-up portion, thereby charging the toner into the toner hopper.

Such a conventional toner supplementing device involved following problems:

Conventional toner supplementing devices are of a structure such that even if the loading of a cartridge in a toner hopper is somewhat imperfect, the flexible sheet is strippable. For this reason, the toner supplementing port will be sometimes inadvertently unsealed, not withstanding the cartridge has not been properly loaded. As the consequence, the toner sometimes scatters through clearances. Particularly, during the image treating operation, the toner has sometimes been blown and leaked out due to the cooling air inside the image forming apparatus or the revolution of toner supplementing rollers, etc.

Cartridges are often so composed as to have a common size, so that their components may be put to common use with different types of image forming apparatuses. Accordingly, when various types of image forming apparatuses are available, there has been a possibility of supplementing toners which are different in properties and color, etc.

SUMMARY OF THE INVENTION

Accordingly, a first object of this invention is to detect the cartridge inserted in the cartridge inserting part of an image forming apparatus, to see whether or not it has been inserted to its appropriate position, thereby enabling prevention of blow-out leakage of toner.

Further, a second object of this invention is to detect the inserted cartridge, to see whether or not it is an appropriate cartridge having the desired toner housed therein. In that way, it becomes possible to supplement a toner of the specified properties or color, thereby averting the trouble of allowing different types of toners to be mixed.

BRIEF DESCRIPTION OF THE DRAWINGS

Furthermore, FIG. 20, partly perspective obliquely observed view of part of a cartridge used in this embodiment; FIG. 21, views of essential parts in perspective; FIG. 22, a longitudinal front sectional view of a toner supplementing device; FIG. 23, a side view of a cartridge; FIG. 24 is a side view of a cartridge being loaded in a toner hopper; and FIGS. 25 and 26, respectively, a perspective view and a sectional view of an essential part illustrating a device modified from the aforementioned embodiment.

DETAILED DESCRIPTION OF PREFERRED EMBODIMENTS

In the following description of embodiments, a copier is explained as a typical example of image forming apparatuses. This invention is, of course, applicable to laser beam printers and facsimilies, and other image forming apparatuses.

In a first embodiment, a magnetism producing means exemplifying a cartridge indicating means is provided in a part of a hollow container for housing a powder toner, so that the existence or type of a cartridge may be detected by sensing the magnetism coming from said magnetism producing means and, moreover, that the copying operation may be stopped so as to avoid producing reject.

In the following, detailed explanation is given using accompanying drawings.

Figure 1:
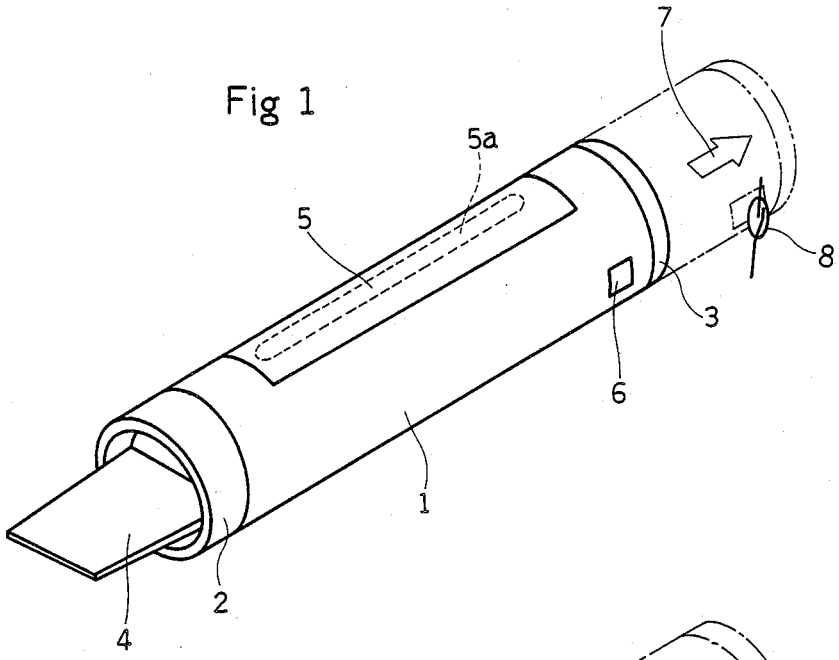
FIG. 1 is a perspective view outlining a cartridge discriminating system embodying this invention.

FIG. 1 is a perspective view of the whole of a cartridge.

Both ends of a hollow cylinder 1 for housing powder toner in its interior are closed with resin made covers 2, 3 and on the covers 2, there is provided a handle part 4 for turning the opening part 5*a* of the cartridge toward the toner supplying port of a developing section, after inserting the cartridge into the copier. The opening part 5*a* is sealed with a sealing member 5 which is to be stripped off, after the cartridge has been loaded in a copier.

In a part of the cartridge, a magnetism producing means 6 such as permanent magnet is provided. And the position where the aforementioned magnetism producing means is placed is where it is nearest to and facing a lead switch 8 being an example of magnetism detecting members mounted on a copier, when the cartridge has been brought under its toner supplementing state by inserting it into the cartridge inserting part, as shown by an arrow 7.

Just as the lead switch 8 has sensed the magnetism, the copier operates. But if it has not sensed any magnetism, indication is made by whatever means that the cartridge is absent or that it is not inserted to its normal position. The operation of the copier may be stopped, as the case may be, lest unacceptable image be erroneously formed For this purpose, a well-known mechanism which makes the indication as well as making the copier immovable, when no paper feeding cassette nor copying paper of the copier exists, is applicable.

As magnetism producing means, normally well-known permanent magnets, electromagnets, magnetic cards, etc., may be employed. As a simple and low cost means, a plate shape rubber magnet may be utilized. And for the magnetism detecting members, lead switches, coils, etc., which are normally available on the market are often used. Particularly, a well-known magnetic head is provided to work with magnetic cards, in this instance, enabling the type, date of manufacture of the toner housed or the color, in the case of color toners, etc., to be written in. These information will be read out by the magnetic head, to conduct functions of a copier such as operation, stop and copying speed change, etc.

Or it is also feasible to change the position where a permanent magnet or an electromagnet such as above-mentioned is placed, depending on the type of the toner housed in the cartridge, and to provide indication detecting means such as a plurality of lead switches, etc., on the copier side in correspondence with these plurality of mounting positions. In this instance, arrangement may be made so that the type discrimination of the toner housed in may be detected by sensing which indication detecting means operates. As other examples of combinations of cartridge indication means and indication detecting means, those adapted for detecting such patterns as employed in embodiments shown in FIGS. 3–12 may be utilized.

Further, as a means for making a large capacity of memory storage on a small area, like magnetic card, IC card may be mentioned, besides it. As characteristics of the toner to be stored on magnetic card or IC card, said production date, color of toner, and production related items such as guarantee period, manufacturing place, manufacturing machine, lot number, etc., or physical properties related items such as various specific gravities, grain size distribution, electric resistance, etc., may be mentioned. As an indication detecting means provided on the copier side for reading out the IC card, a well-known analyzer is used.

Figure 2:
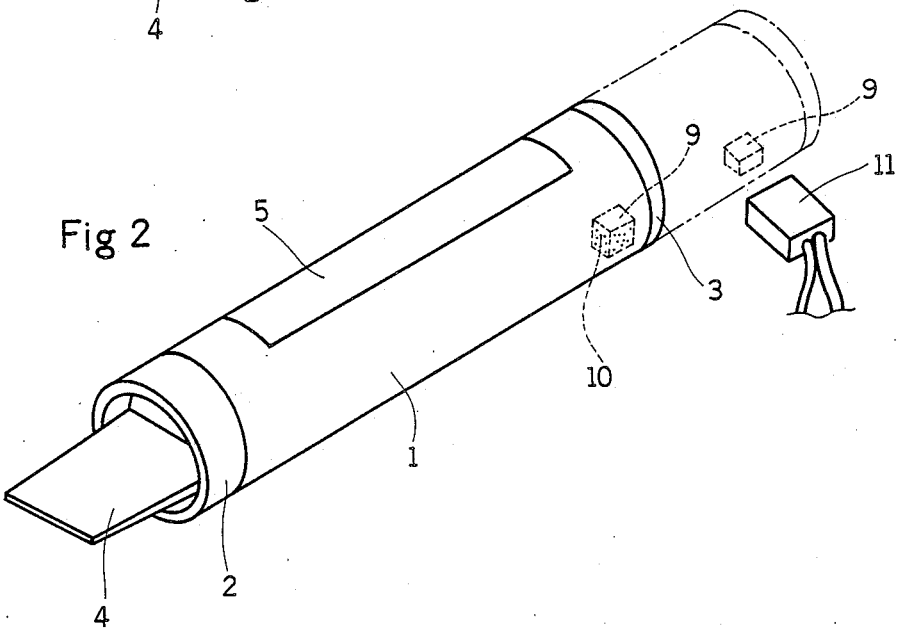
FIG. 2 is a perspective view showing its modified embodiment.

In an embodiment shown in FIG. 2, in part of a hollow container, a compartment is formed, to house a developer formed of a toner and a carrier. Existence of appropriate toner cartridge is detected by sensing the permeability of said developer with a magnetic sensor located on a side of the copier proper.

Generally, a copier is of a structure such that a magnetic sensor called toner control sensor for keeping constant the toner concentration in the developer is provided in a developing apparatus, to make supplementation of toner, when the toner concentration has undergone a change (it normally declines). This embodiment takes advantage of this phenomenon; thus, as shown in FIG. 2, a small container 9 is provided in a part of a cartridge, to house therein a developer consisting of a toner and a carrier being a magnetic body which ensures the best conditions for the copier.

The specified place is where it is brought to a neighborhood of and facing a permeability sensor 11 being an example of magnetic sensors mounted on a copier, when the toner supplementing state is brought about by loading a cartridge in the cartridge inserting section. If the permeability of the developer 10, as sensed by a permeability sensor 11, falls within the permissible range, as compared with the value of permeability which has been preset, the copier will be operated. If values outside this range are detected or no permeability is sensed, absence of appropriate cartridge will be indicated by whatever means. The copier's operation is to be stopped, as the case may be, lest unacceptable image be erroneously prepared. Accordingly, the well-known mechanism that makes indication or makes the copier inoperable, when no paper feeding cassette or copying paper of the copier exists will be usable. If such a permeability sensor 11 is used in common as an already installed permeability sensor for detecting the developer concentration inside the developing apparatus, reduction in cost will be further promoted.

In the devices shown in FIG. 2, same code numbers are used for elements common to those shown in FIG. 1 without giving their definitions.

In the aforementioned embodiment, the suitability of cartridge or whether it is adequately inserted or not is detected, when the cartridge is in the state of being inserted to the toner supplementing position. However, particularly, for detecting the suitability of a cartridge, there is no necessity of inserting the cartridge to the toner supplementing position. But it is rather desirable to make the judgement of suitability in the state that only the tip part of the cartridge is a little inserted. This will facilitate the operation.

In embodiments represented by FIGS. 3–12, this concept is particularly taken into account.

Thus in the following embodiments, while a cartridge indicating means is provided on a part of a cartridge for housing toner, an indication detecting means for detecting the aforementioned cartridge indicating means and a cartridge insertion preventing means for preventing complete insertion of the cartridge are provided on the image forming apparatus side, so that when the cartridge has been inserted in the cartridge inserting part of the image forming apparatus, the type suitability of the cartridge inserted is checked by the aforementioned indication detecting means; then, only when proper cartridge is inserted, its perfect insertion will be permitted by unlocking the aforementioned cartridge insertion preventing means; such a cartridge discriminating system is provided.

Figure 3:
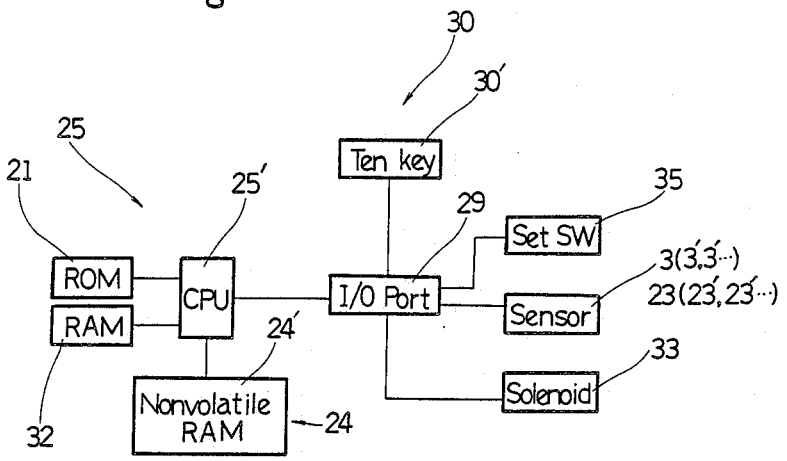
FIG. 3 is a block diagram of control circuit of another cartridge discriminating system embodying this invention.
Figure 4:
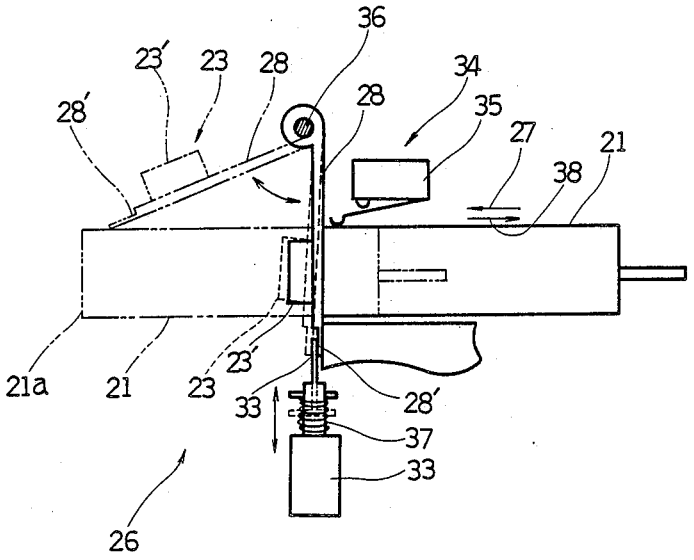
FIG. 4 is a schematic side view of a cartridge insertion preventing means usable with the aforementioned embodiments.

In the following, detailed description is made with reference to the accompanying drawings:

In a copier of this embodiment, a plural number of types of toners are housed in a common shape cartridge and replenishment of toner is made by displacement of the cartridge. Such a copier is, as shown in FIGS. 3–5, comprised of an indication 22, being an example of cartridge indicating means, which is formed on the outside surface of a cartridge 21 and corresponding to the type of toner, an indication detecting means 23 for detecting the aforementioned indication 22, when the aforementioned cartridge 21 is loaded into the copier not shown in this figure, an operation section 30 for selecting and specifying the indication to be used as the reference, a reference indication storing means 24 for storing the indication to be used as the reference which has been selected and specified by the aforementioned operation section 30, a comparing means 25 for comparing the signal from the aforementioned indication detecting means 23 with the information from the reference indication storing means 24 and a cartridge insertion preventing means 26 for permitting the cartridge 21 to be loaded, only when the signal from the aforementioned indication detecting means 23 and the information from the reference indication storing means 24 are in agreement with each other.

Figure 5:
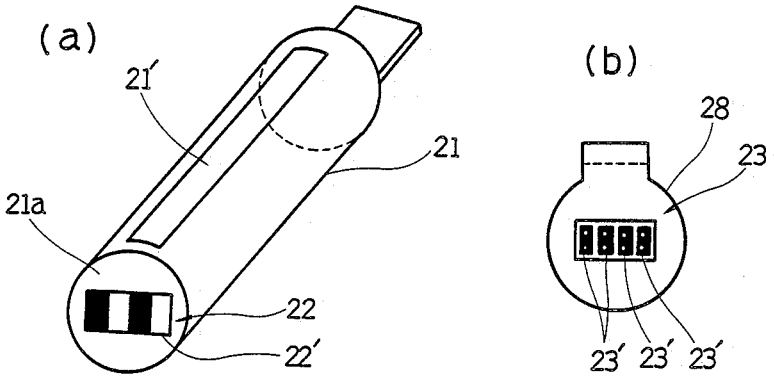
FIG. 5 (*a*) and (*b*) are, respectively, a perspective view of a cartridge equipped with a cartridge indicating means usable in the same embodiments and a front view of an indication detecting means capable of detecting said indicating means.

The aforementioned indication 22 is, as shown in FIG. 5 (*a*), composed of a marker code 22' differentiated corresponding to the type of toner. This indication 22 is stuck on the bottom wall 21*a* at the end part, as seen in its loading direction (as shown by arrow 27) into the copier, not shown in this figure, of a cartridge 21 formed in a cylindrical shape and having on its side wall an opening 21' for supplying toner (sealed with a tape, when out of use).

The aforementioned indication detecting means 23 is composed of a plurality of photoelectric reflection type sensors 23', 23', . . . , as shown in FIG. 5 (*b*). And this indication detecting means 23 is provided at a position on the front of the later described cover 28, being a component of the aforementioned cartridge insertion preventing means 26, and facing the marker code 22' of the cartridge 21, when the cartridge 21 is loaded into the copier This indication detecting means 23 is connected to the input part of the I/0 port 29 (refer to FIG. 3) which is linked to the later described CPU 25', being a component of the aforementioned comparison means 25.

Such an indication detecting means 23 detects the type of the cartridge 21 through combination of output signals from a plurality of photoelectric reflection type sensors 23', 23', which make on or off, corresponding to the marker code 22' of the cartridge 21, when loaded into the copier proper.

The aforementioned operating section 30 is composed of ten keys 30' (refer to FIG. 3) on the operation panel equipped on the copier proper not shown in this figure and is connected to the input part of the I/0 port 29. By these ten keys 30', a set code corresponding to the marker code 22' of the proper cartridge 21 is input to the I/0 port 29.

The aforementioned reference indication storing means 24 is composed of an nonvolatile RAM 24' and is linked to CPU 25'. This nonvolatile RAM 24' is used for storing the preset code corresponding to the marker code 22', which has been input from the aforementioned ten keys 30' through the I/0 port 29 and CPU 25'. The preset code may be rewritten, whereby it is possible to respond to use of different types of toners.

The aforementioned comparison means 25 is composed of such memories as ROM 31, RAM 32, etc., and CPU 25'; it compares the information from the indication detecting means 23 which has been entered through the aforementioned I/0 port 29 with the preset code stored in the nonvolatile RAM 24' and when they are in agreement, delivers an operation signal to the later-described solenoid 33 of the cartridge insertion preventing means 26.

The aforementioned cartridge insertion preventing means 26 is equipped with a set switch 35 as shown in FIG. 4, located in the neighborhood of the cartridge inserting part 34 of a copier proper, not shown in this figure. This set switch 35 is adapted to detect the aforementioned cartridge 21, when its end has been inserted into the cartridge inserting section, thereupon to start reading of the information from the aforementioned indication detecting means 23; it is connected to the input port of the aforementioned I/0 port 29.

On the shaft 36 placed upward of the aforementioned cartridge inserting part 34, a cover 28 for opening—closing said cartridge inserting part 34 is movably slung to make free opening—closing. On the front of this cover 28, the indication detecting means 23 is mounted, as hereabove described. Further, at one end part (free end) of the cover 28, a part to be engaged 28' is formed.

Downward of the aforementioned cartridge inserting part 34, a solenoid 33 is fitted. On the armature of this solenoid 33, there is provided an engaging part 33' which engages with the part 28' to be engaged. Numeral 37 is a reset spring for the aforementioned armature. The aforementioned solenoid 33 is connected with the output port of the aforementioned I/0 port 29.

When the aforementioned solenoid 33 is in off state, the aforementioned cover 28 is prevented from opening, with the engaging part 33' engaging with the part to be engaged 28'(the state shown by a real line in FIG. 4) When it is on state, their engagement is undone, making the cover freely openable, whereby loading of cartridge 21 is permitted (the state shown in FIG. 4 by a double dotted chain line).

Figure 6:
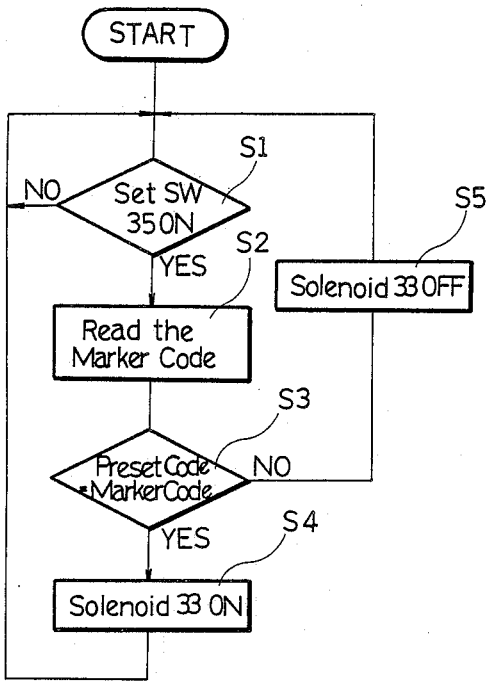
FIG. 6 is a flow chart showing the processing procedure in these embodiments.

Next, the operation of the apparatus composed as hereabove-described is described based on flow charts given in FIGS. 3, 4 and 6.

Here, the codes S1, S2, . . . , etc., in FIG. 6 show the numbers of respective process (step).

First, in order to select and specify, as an initial presetting, only the cartridge 21 in which a certain type of toner the user is to use is housed, the preset code corresponding to the marker code 22' of said cartridge 21 is in-putted by operating the ten keys 30'. Said preset code is, then, stored in the nonvolatile RAM 24'.

Next, as an operator is to load a new cartridge into the copier proper, after drawing out a used cartridge, when replacing toner, an end part of said cartridge abuts on the set switch 35, as shown by a real line in FIG. 4; as a consequence, the set switch 35 is made on. At the same time, the marker code 22' of the cartridge 21 and the indication detecting means 23 on the cover 28 approach and face each other (S1) As a result, the information of the marker code 22' on the cartridge 21 is read into CPU 25' from the aforementioned indication detecting means 23 through the I/0 port 29 (S2).

The aforementioned CPU 25' makes a comparison between the information of the aforementioned marker code 22' and the preset code of the aforementioned nonvolatile RAM 24'. When both codes are in agreement with each other (S3), the solenoid 33 is made on (S4) through I/0 port 29. Then the engagement between the part 28' to be engaged of the cover 28 and the engaging part 33' of the solenoid 33 is undone; consequently, the cover 28 is brought into openable state.

As a result, the cartridge 21 pushes and opens the cover 28 by its end part, for it to be loaded into the copier proper (the state shown by a double dotted chain line in FIG. 2).

At this time, the set switch 35 stays being in its on state, while the indication detecting means 23 fitted on the cover 28 detects a part other than the marker code 22'(a state identical to that in which the information of the marker code 22' and the preset code in the nonvolatile RAM 24' are not in agreement with each other, as later described, is brought about); therefore, the solenoid 33 is made off and reset to its state shown by a real line in FIG. 4 by dint of the repulsive force of the spring 37.

On the other hand, when the information of the marker code 22' and the preset code of the nonvolatile RAM 24' are not in agreement (S3), that is, when an inadequate cartridge 21 has been inserted, the solenoid 33 will not be made on, but remain in its off state (S5). Accordingly, the engagement between the part to be engaged 28' of the cover 8 and the engaging part 33' of the solenoid 33 is not undone. Consequently, the end part of the cartridge 1 can not push and open the aforementioned cover 28; thus, the cartridge cannot be loaded into the copier proper.

That is to say, loading into the copier proper of cartridges other than those whose codes have been registered beforehand will be all prevented.

Next, when the aforementioned cartridge 21 is drawn out in the direction of the arrow 38, in order to take said cartridge 21 out of the copier proper, the cover 28 will swing downward, to restore its former state (the state shown by a real line in FIG. 4) by its own weight or by the action of a spring not shown in this figure.

And when the indication detecting means 23 on the cover 28 has reached the position where it again faces the marker code 22' of the cartridge 1, the information of said marker code 22' is again read into CPU 25' from the aforementioned indication detecting means 23; then, since it is in agreement with the preset code of the nonvolatile RAM 24', the solenoid 33 is made on. Thereby, the cover 28 returns to the real line position shown in FIG. 4.

As the aforementioned cartridge 21 has been completely taken out, the aforementioned solenoid 33 is again made off, so that it is restored to its former state by the repulsive force of the spring 37. Thus the part 28' to be engaged of the cover 28 and the engaging part 33' of the solenoid 33 are locked, making the cover 28 unable to open (the cartridge insertion preventing state is brought about).

As hereabove described, in this embodiment, it is not only possible to freely select and specify any appropriate one from among a plurality of cartridges by the use of ten keys 30', but once a cartridge is selected and specified by the aforementioned operation section 30, loading of cartridges 21 other than the specified one is all prevented.

Figure 7:
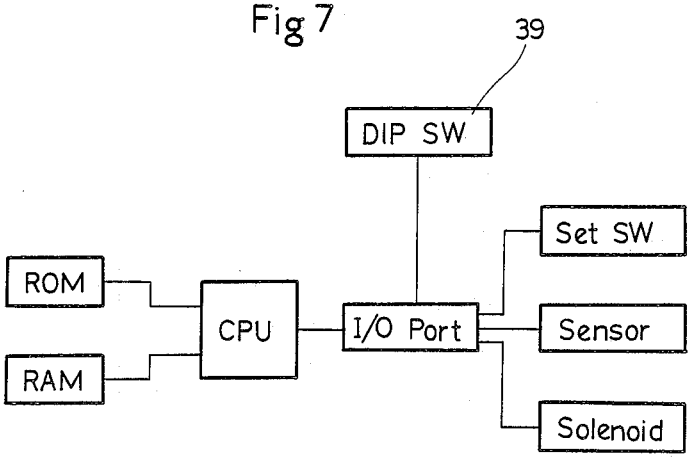
FIG. 7 is a block diagram of a control circuit usable in cartridge discriminating system of another embodiment.

While in the aforementioned embodiment, the operation section 30 and the reference indication storing means 24 (refer to FIG. 1) are composed of ten keys 30' and an nonvolatile RAM 24', respectively, it is also feasible to compose them in such a way as to input the preset code, using a DIP switch 39, to be stored by hard-ware as shown in FIG. 7.

Further, in the aforementioned embodiment, while the solenoid 23 is off, when the cartridge 21 is loaded in the copier proper, even though the preset switch 35 is on, it is possible to keep the aforementioned solenoid 33 always in its on state, so long as the set switch 35 is on, even when the cartridge 21 is loaded in the copier proper.

Figure 8:
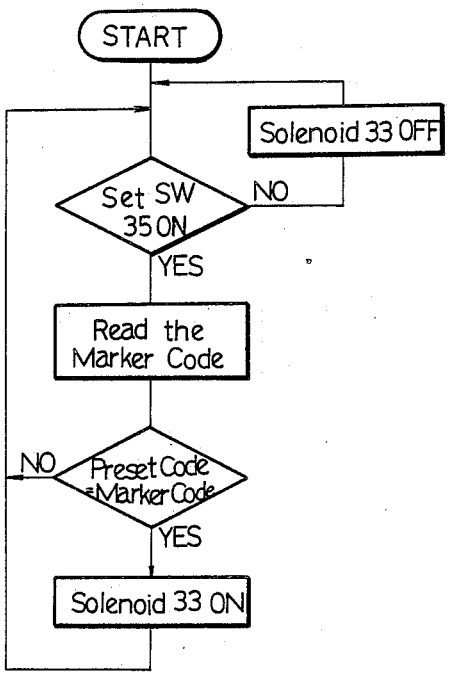
FIG. 8 is a flow chart showing the processing procedure of this system.

The processing procedure of this case is shown in the flow chart of FIG. 8. This flow chart gives a composition such that when the set switch 35 is in its off state, the solenoid 13 is also off.

Figure 9:
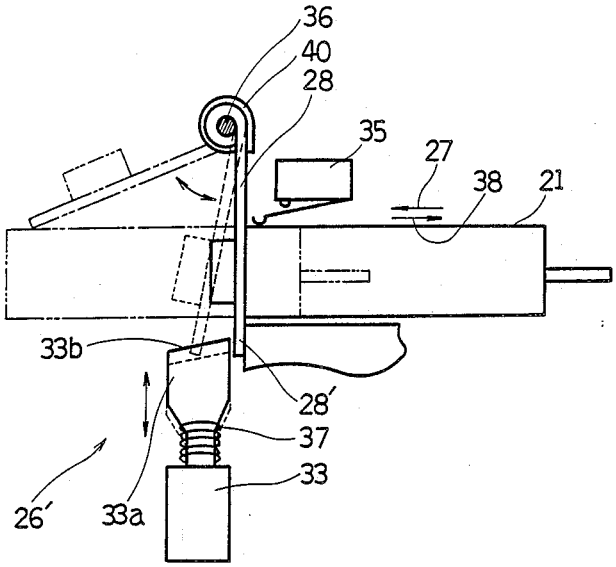
FIG. 9 is a schematic side view of a modified version of the cartridge insertion preventing means.

Next, a modified form 26' of the cartridge insertion preventing means 26 is explained, based on FIG. 9.

The cartridge insertion preventing means 26' is nearly similar in basic structure as the aforementioned one shown in FIG. 4.

In said cartridge insertion preventing means 26', a bevel **33*b* is formed on the top surface of the engaging part 33*a* of the solenoid 33. Further, on the part of the cover 28 for hanging it by a shaft 36, a spring 40 for restoring the cover 28 is provided. The elastic biasing force of said spring 40 is so set that it can push down the armature in defiance of the elastic biasing force of the spring 37 attached to the solenoid 33**.

Since the cartridge insertion preventing means 26' is composed as hereabove-described, the solenoid 33 need not be made on as in the case of the aforementioned cartridge insertion preventing means 6, when the cover 28 is restored to its former state (the state shown by a real line in FIG. 9). Thus the aforementioned cover 28 can recover its former state, while getting the part 28' to be engaged of said cover 28 abutting on and pressuring downward the aforementioned bevel part **33*b* by elastic biasing force of spring 40**.

Figure 10:
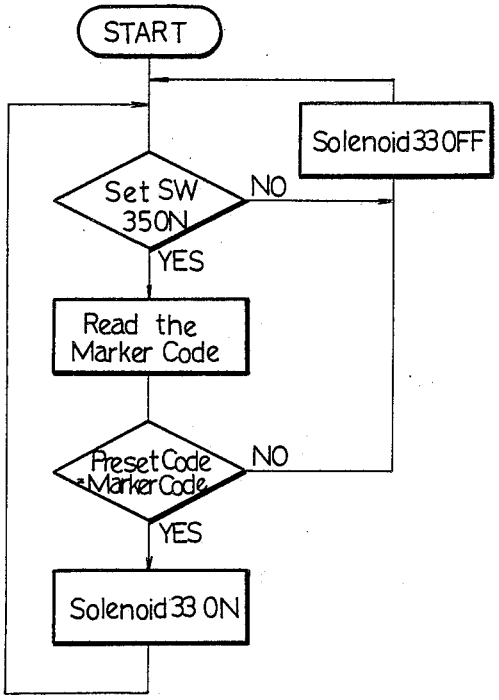
FIG. 10 is a flow chart showing the processing procedure for operating the cartridge insertion preventing means shown in FIG. 9.

The processing procedure when the aforementioned cartridge insertion preventing means 26' is used is shown in a flow chart of FIG. 10. According to this flow chart, the system is so composed that when the set switch 35 is in off state or when the information code from the indication detect means 23 in the comparing means 25 does not coincide with the set code stored in the nonvolatile RAM 24', the solenoid 33 be made off.

Figure 11:
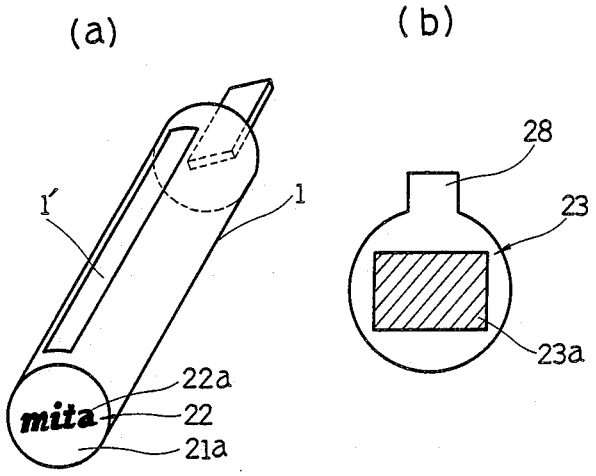
FIGS. 11 (*a*) and (*b*) are, respectively, a perspective view of a cartridge equipped with a cartridge indicating means usable with a cartridge discriminating system of another embodiment and a front view of an indication detecting means capable of detecting said cartridge indicating means.
Figure 12:
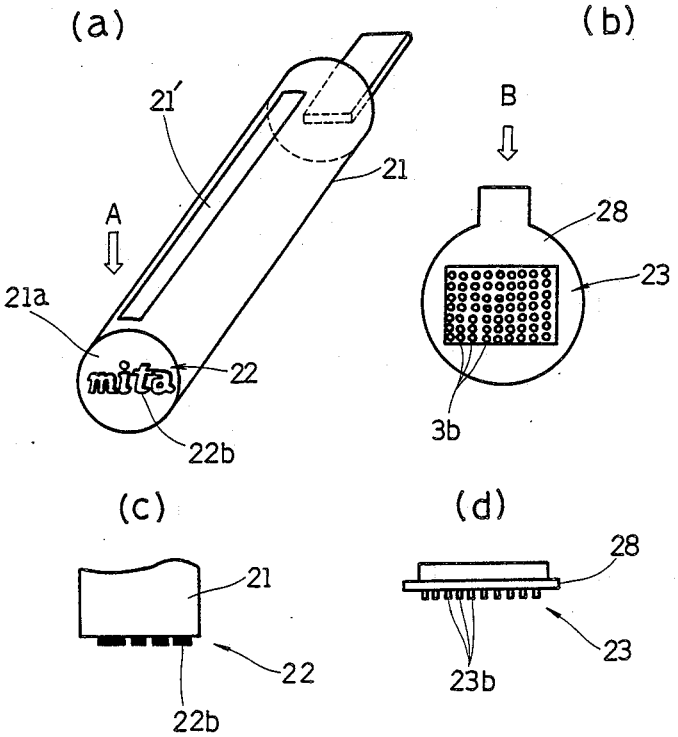
FIGS. 12 (*a*), (*b*), (*c*) and (*d*) are, respectively, a perspective view of a cartridge usable with another embodiment equipped with a cartridge indicating means, a front view of an indication detecting means, a plan view taken in the direction of the arrow A and a plan view taken in the direction of the arrow B.

The indication 22 of aforementioned embodiment and the indication detecting means 23 (refer to FIGS. 5 (*a*)

and (*b*)) may be composed of a printed pattern 22*a* and a CCD sensor 23*a* for detecting said pattern 22*a* (refer to FIGS. 11 (*a*) and (*b*)), or an undulatingly configured logo mark 22*b* and a plurality of juxtaposed microswitches 23*b*, 23*b*, . . . for detecting the undulating configuration of said logo mark 22*b* (refer to FIGS. 12 (*a*), (*b*), (*c*) and (*d*)) and so forth. For the aforementioned pattern, those differing in lightness or those with colors may be contemplated. As the indication detecting means in aforementioned embodiments, photosensors for detecting the light and shade or those for detecting colors may be employed.

Such cartridge indicating means and indication detecting means for detecting them shown in FIGS. 5, 11 and 12 are of course applicable to the embodiment shown in FIG. 1.

The aforementioned embodiment is so composed that the stored data may be freely up-dated, using an nonvolatile RAM 24 or a DIP switch 39 as a reference indication storing means, but use of ROM is permissible, when up-dating of the stored data is unnecessary or when exchange of storage element will do.

In the following, embodiments for preventing to select wrong color of toner are described with reference to FIGS. 13–15. In this instance, as for the cartridge insertion preventing means, the one shown in FIG. 4 or FIG. 9 may be utilized as it is; therefore, its detailed explanation is omitted.

This embodiment is characterized in that the cartridge indication means is a transparent window formed in the cartridge and that the indication detecting means is a color sensor.

Figure 13:
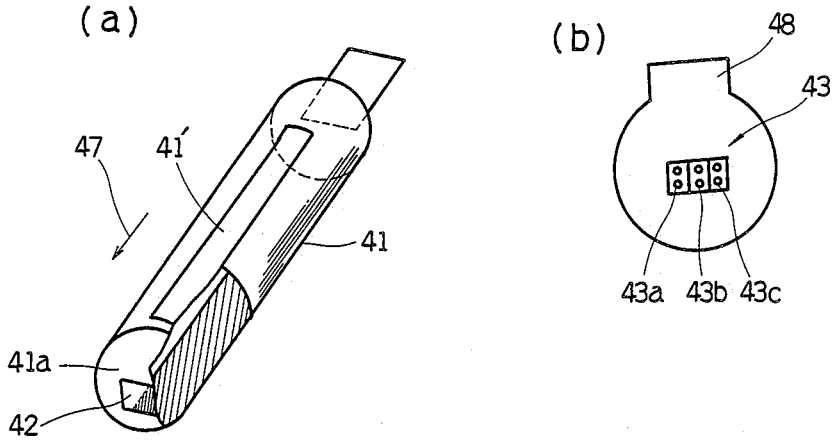
FIGS. 13 (*a*) and (*b*) are, respectively, a perspective views of a cartridge equipped with a transparent window used in another embodiment of this invention and a front view of an indication detecting means for detecting the color of the color toner inside the cartridge through this transparent window.
Figure 14:
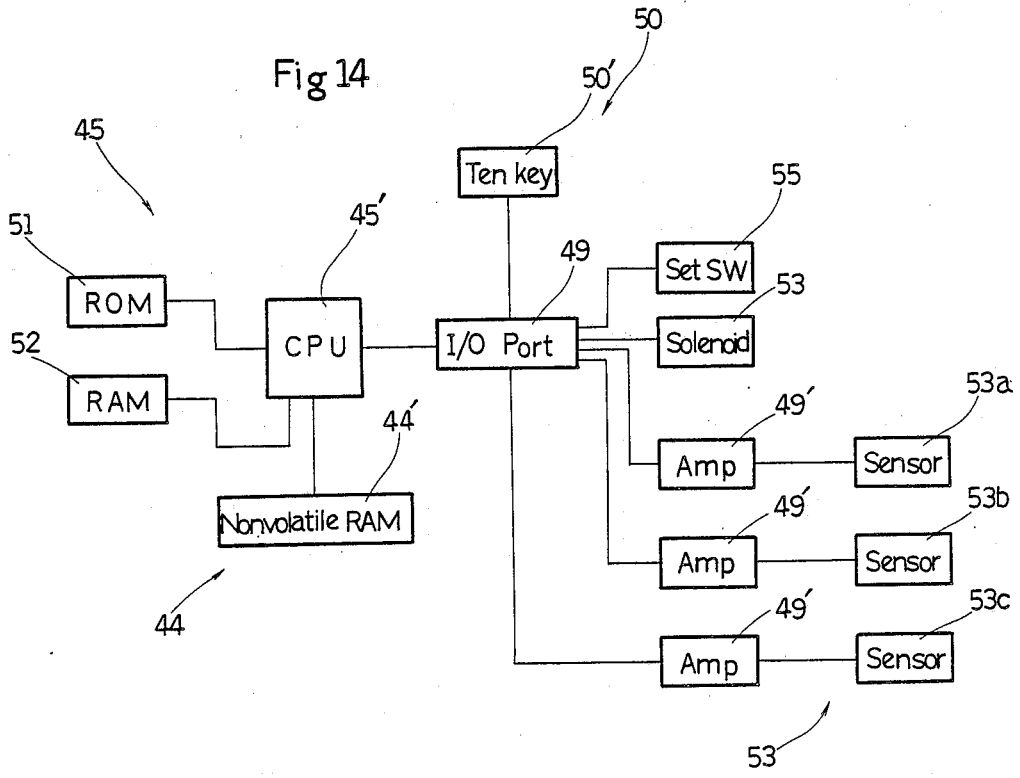
FIGS. 14 and 15 are, respectively, block diagrams of different control circuits of cartridge discriminating system of this embodiment.
Figure 15:
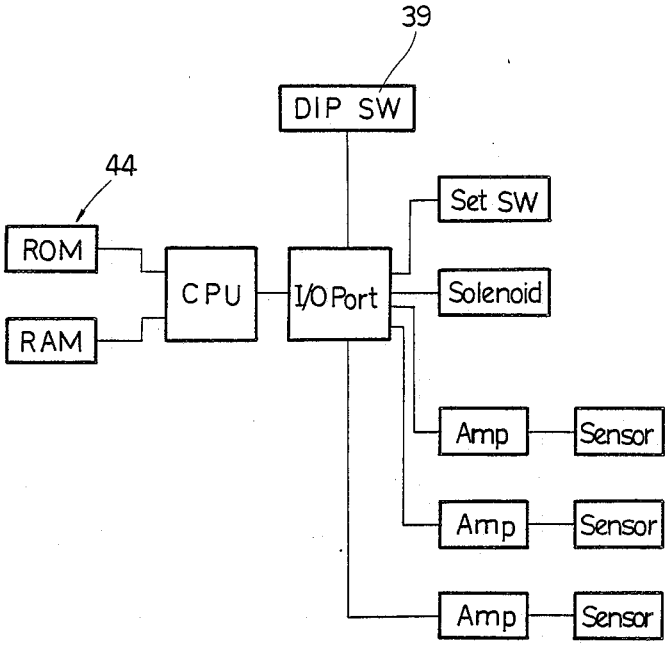

This embodiment is comprised, as shown in FIGS. 13 and 14, of a cartridge 41 equipped with a transparent window 42 which enables observance from outside of the color toner housed in this cartridge 41, an indication detecting means 43 for detecting the color of the color toner inside the cartridge 41 through the aforementioned transparent window 42, when the aforementioned cartridge 41 is loaded into a copier proper not shown in these figures, a reference color storing means 44, being an example of reference indication storing means, for storing the preset code corresponding to the color selected as the reference, a comparison means 45 for making comparison between the signal from the aforementioned detecting means 43 and the information from the reference color storing means 44 and a cartridge insertion preventing means 26 (FIG. 4) or 26'(FIG. 9) which permits loading of the cartridge 1, only when the signal from the aforementioned detecting means 43 and the information of the reference color storing means 44 is in agreement with each other.

The aforementioned transparent window 42 is, as shown in FIG. 13 (*a*), is sealed with a transparent film. The cartridge 41 has a toner supplying opening part 41' (sealed with a tape, when not in use) formed in its periphery and the aforementioned transparent window 42 formed in the bottom wall 41*a* of the end part, as seen in its loading direction (the arrow direction 47) toward the copier proper not shown in this figure.

The aforementioned indication detecting means 43 is composed of color sensors 43*a*, 43*b* and 43*c* consisting of photodiodes with blue, red and yellow filters attached and a light emitting part, as shown in FIG. 13 (*b*). These color sensors of the indication detecting means 43 are juxtaposed on the front surface of the cover 28, being a component of the aforementioned cartridge insertion preventing means 26 or 26', and are to be brought to a position where they face the transparent window 42 of the cartridge 41, when the cartridge 41 is loaded into the copier proper.

Further, this indication detecting means 43 is, as shown in FIG. 14 is connected through amplifiers 49', 49', 49' to the input part of the I/0 port 49 linked to CPU 45' being a component of the aforementioned comparing means 45.

The aforementioned reference color storing means 44 is composed of an nonvolatile RAM 44' and is connected to CPU 45'. This nonvolatile RAM 44' is adapted for storing the preset code corresponding to the color of the color toner to be used.

The aforementioned comparison means 45 is composed of such memories as ROM 51, RAM 52, etc., and CPU 45', compares the information inputted from the detecting means 43 through the aforementioned amplifiers 49', 49', 49' and I/0 port 49 with the preset code in the involatile RAM 44'. And when they are in agreement with each other, the comparison means 45 will deliver an operation signal to the solenoid 33 of the cartridge insertion preventing means 26.

Since the operation of this embodiment is quite similar to those represented by flow charts shown in the aforementioned FIGS. 6, 8 and 10, its explanation is omitted. And a block diagram representing its operation when a DIP switch 39 is used as the reference color storing means is presented as in FIG. 15.

In the embodiment described hereunder, a data (indication) intrinsic to the developing device is attached to the developing equipment and this data and the indication attached to a cartridge are referenced to each other and when they are in agreement with each other, the state in which the toner supplementation is possible is evidenced.

Thus this embodiment may be summarized as a cartridge discriminating system for image forming apparatus replaceably equipped with a developing equipment for developing static latent image by supplying toner to a photoreceptor, in which while a cartridge indicating means is provided on a part of a cartridge for housing toner, a developing equipment indicating means is provided on a part of the developing equipment; and while an indication detecting means which detects the aforementioned cartridge indication means is provided on the image forming apparatus proper side, there is provided a developing equipment detecting means for detecting the aforementioned developing equipment, when the aforementioned developing equipment is attached to the image forming apparatus proper, so that when the cartridge is inserted into the cartridge inserting part of the image forming apparatus proper, the suitability of the type of the cartridge inserted may be detected by making comparison between the indication data detected by the aforementioned indication detecting means and the data detected by the developing equipment detecting means.

In the following, this embodiment is described in detail in conjunction with accompanying drawings; While this embodiment is described in discriminating color toners color by color, it goes without saying that it is applicable to discrimination of toners on a basis of their other characteristics, etc.

Figure 16:
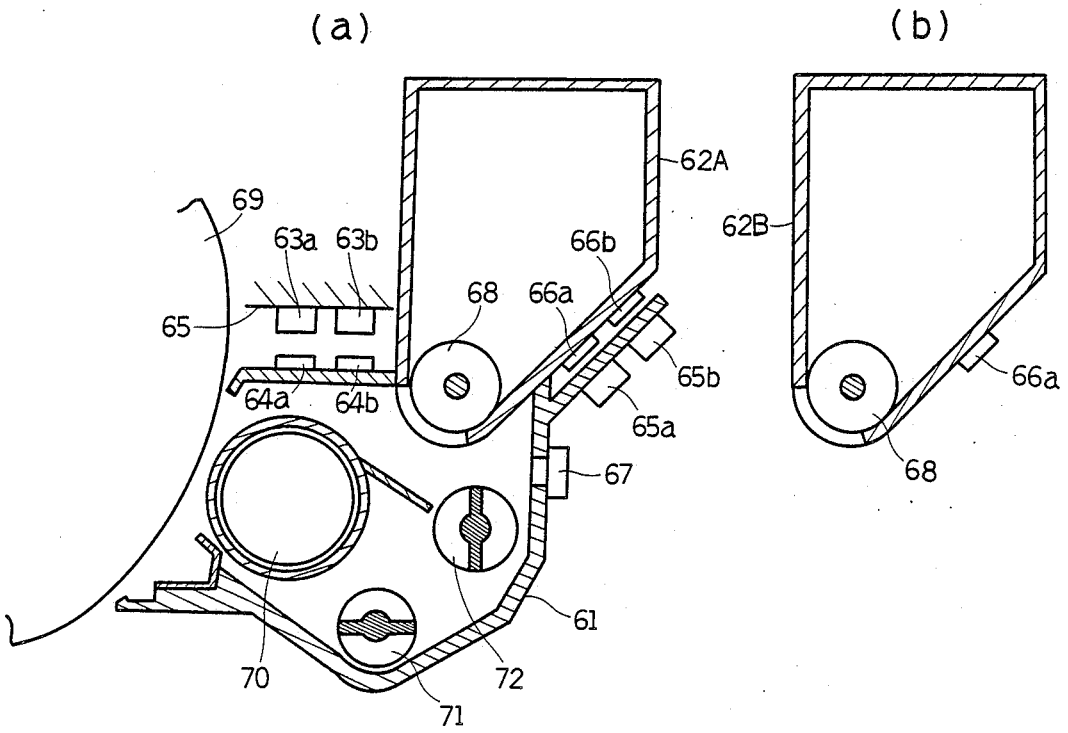
FIGS. 16 (*a*) and (*b*) are, respectively, diagrams for explanation of structure showing essential parts of a cartridge discriminating system of another embodiment of this invention.

FIG. 16 (*a*) is an explanatory diagram showing a principal part of this embodiment, in which 61 denotes a developing equipment for red color to be replaceably mounted on a copier proper (not shown in this figure); 62A, a toner hopper for red color, being an example of a cartridge, which is replaceably mounted on the developing equipment 61; 63*a* and 63*b*, lead switches, being an example of developing equipment detecting means, which are, respectively, installed on the wall 65 of the copier proper; 64*a* and 64*b*, magnetic material pieces, being an example of developing equipment indicating means, which make on respective lead switches 63*a* and 63*b*, when the developing equipment 61 has been mounted on the copier proper (in the state of FIG. 1 (a)); 65*a* and 65*b*, lead switches, being an example of indication detecting means respectively installed on the developing equipment 61; 66*a* and 66*b*, magnetic material pieces, being an example of cartridge indicating means, for making lead switches 65*a* and 65*b* on, respectively, when the toner hopper 62A is mounted on the developing equipment 61 (in the state of FIG. 1 (*a*); 67, a toner concentration sensor for detecting the toner concentration inside the developing equipment 61; 68, a toner supplementing roller for supplementing toner from a toner hopper 62A to the developing equipment 61; 69, a photoreceptor drum; 70, a developer roller for use in developing static latent image by supplying toner to the surface of photoreceptor drum 69; and ;71 and 72, stirring rollers for mixing toner and carrier inside the developing equipment 61. In FIG. 16 (*b*), 62B designates a toner hopper for blue, on which a magnetic material piece 66*a* is provided.

Figure 17:
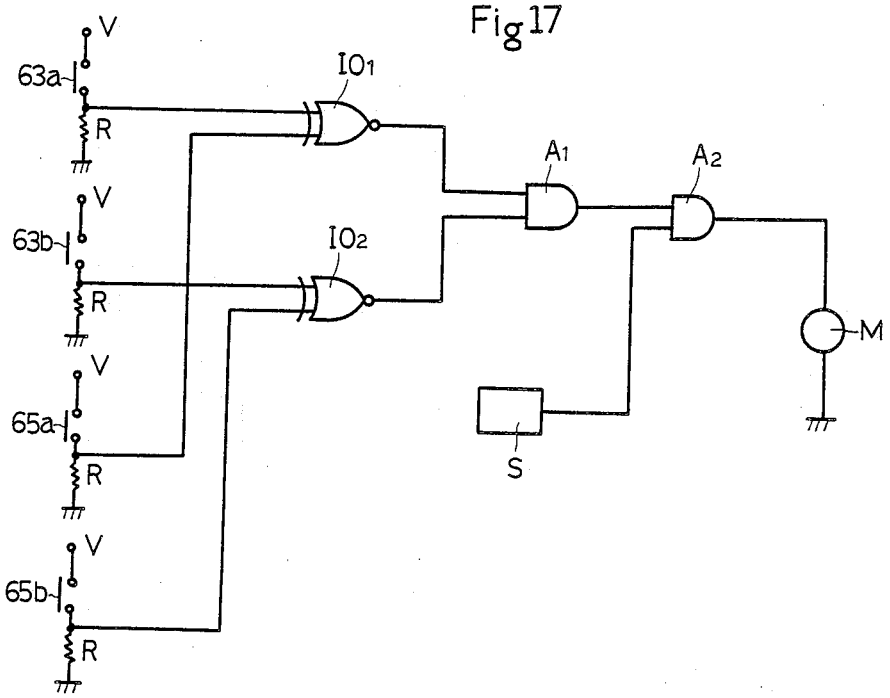
FIG. 17 is an electric circuit diagram showing an essential part of a control circuit of the embodiment shown in FIG. 16.

FIG. 17 is an electric circuit diagram showing an essential part of the control circuit for the apparatus shown in FIG. 16 (*a*), in which R represents series connected resistances which respectively connect lead switches 63*a*, 63*b*, 65*a*, 65*b* to power sources V; $IO_1$ and $IO_2$, exclusive NOR circuits each of which out-puts 1, when respective two input signals are both 1 or both 0; $A_1$, and $A_2$, respectively AND circuits; S, a toner supplementing signal circuit which outputs 1, when the toner concentration sensor 67 (FIG. 16 (*a*)) gives a value lower than the specified value; and M, a motor for turning the toner supplementing roller 68.

In this composition, as the red color developing equipment 61 and the red color toner hopper 62A are installed in place, lead switches 63*a*, 63*b* and 65*a*, 65*b* are respectively made on by the magnetic material pieces 64*a*, 64*b* and 66*a*, 66*b*, respectively facing them. Later, referring to FIG. 2, into the exclusive NOR circuits $IO_1IO_2$ both 1 is inputted and both output 1. Later, the AND circuit $A_1$ outputs 1 and, then, when the toner supplementation signal circuit S outputs 1, the AND circuit $A_2$ outputs 1; then, the motor M is driven, to let the toner supplementing roller 68 turn, until the toner supplementation signal circuit S outputs 0.

However, when a blue color toner hopper 62B shown in FIG. 1 (*b*) is mistakenly mounted on the red color developing equipment 61, the lead switch 65*b* is made off, and the lead switches 63*a*, 63*b* and 65*a*, on; therefore, the exclusive NOR circuit $IO_1$ outputs 1, but the exclusive NOR circuit $IO_2$ outputs 0. Accordingly, the output from the AND circuit $A_1$ becomes 0, so that even when the toner supplement signal circuit S outputs 1, the AND circuit $A_2$ does not output 1; consequently, the motor M will not run; thus, no supplementation of toner from the blue color toner hopper 62B will take place.

Thus in this embodiment, by the circuit shown in FIG. 17, the toner inside the developing equipment 61 and the toner inside the toner hopper 62 are judged to be the same type, only when the lead switches 63*a* and 63*b* and the lead switches 65*a* and 65*b* are in the same on—off combination state. In this way, discrimination can be made between different four color toners.

Figure 18:
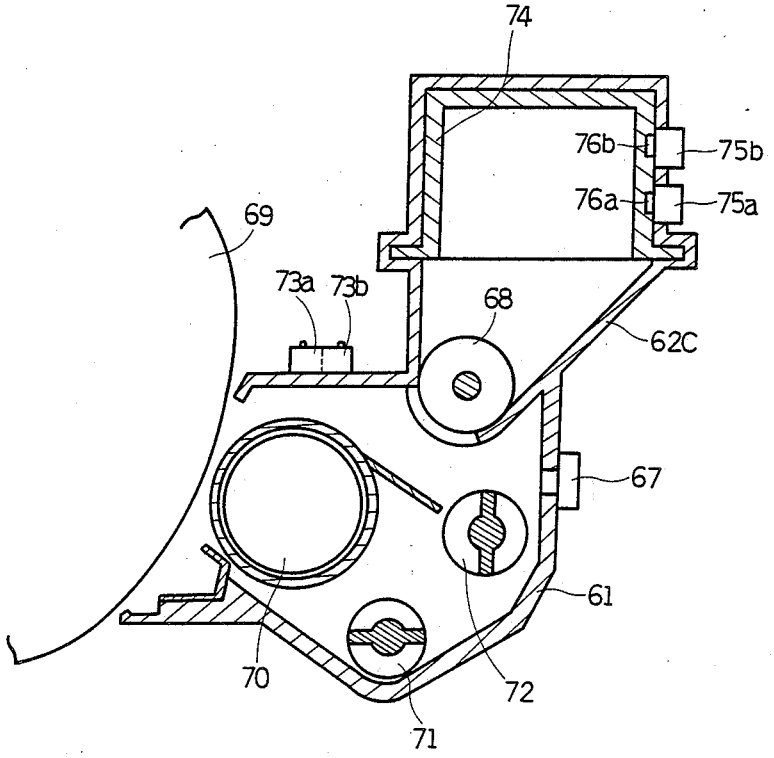
FIG. 18 is a drawing corresponding to FIG. 16 illustrating a modification of the embodiment shown in FIG. 16.

FIG. 18 is a diagram corresponding to FIG. 16 (*a*) showing another embodiment, in which in place of the replaceable red color toner hopper 62A in FIG. 16 (*a*), a toner hopper 62C equipped with a replaceable red color toner cartridge 74 is integrally combined with a red color developing equipment 61. Further, in place of lead switches 65*a*, 65*b* installed on the red color developing equipment 61 in FIG. 16 (*a*), there are installed lead switches 75*a*, 75*b* on a toner hopper 62C; in place of the magnetic material pieces 66*a*, 66*b* provided on the toner hopper 62A in FIG. 16 (*a*), magnetic material pieces 76*a*, 76*b* on the red color toner cartridge 74; and in place of the lead switches 63*a*, 63*b* installed on the wall surface 65 of the copier proper, DIP switches 73*a*, 73*b* preset in closed circuit state on the red color developing equipment 61.

In this composition, when the developing equipment 61 and the toner cartridge 74 are respectively installed, as shown in FIG. 18, the control circuit of FIG. 17 will come into operation similarly as in the above-described embodiment.

In an embodiment described hereunder, a mechanical cartridge indication part normally prevents stripping of the flexible sheet which seals the toner supplementing port of the cartridge and only when a proper cartridge is inserted into the cartridge inserting part, the aforementioned cartridge indication part's prevention is unlocked, thereby to permit stripping of the flexible sheet.

Thus the gist of this embodiment is summarized as a cartridge discriminating system for an image forming apparatus using a toner housing cartridge of a composition such that the toner supplementing port is sealed with a flexible sheet folded in two plies and the toner supplementing port is to be unsealed by stripping off the flexible sheet by pulling the turned-up part of portion of said flexible sheet, in which there are provided on a part of the toner housing cartridge a swingable lever form indication part which prevents the flexible sheet's stripping, and on the cartridge inserting part on the image forming apparatus proper side, an indication detecting means which unlocks the stripping preventing state by means of the swingable lever form indication part by loading the aforementioned cartridge in the specified position therein.

Figure 19:
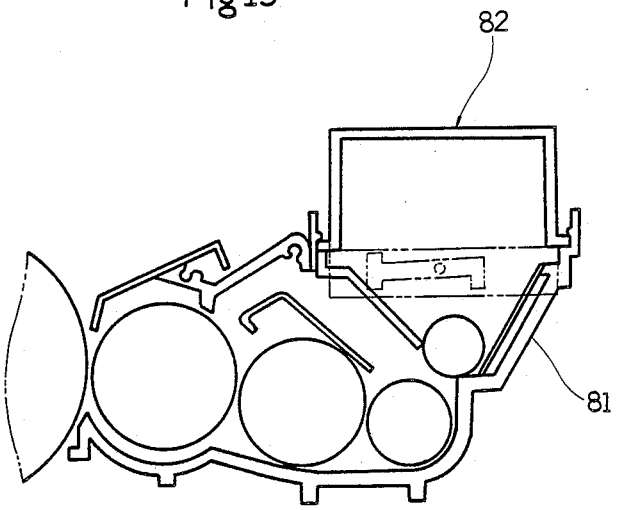
FIGS. 19 through 26 show cartridge discriminating system of other embodiments of this invention, FIG. 19 being a schematic longitudinal side sectional view of a toner supplementing device used in this system.
Figure 20:
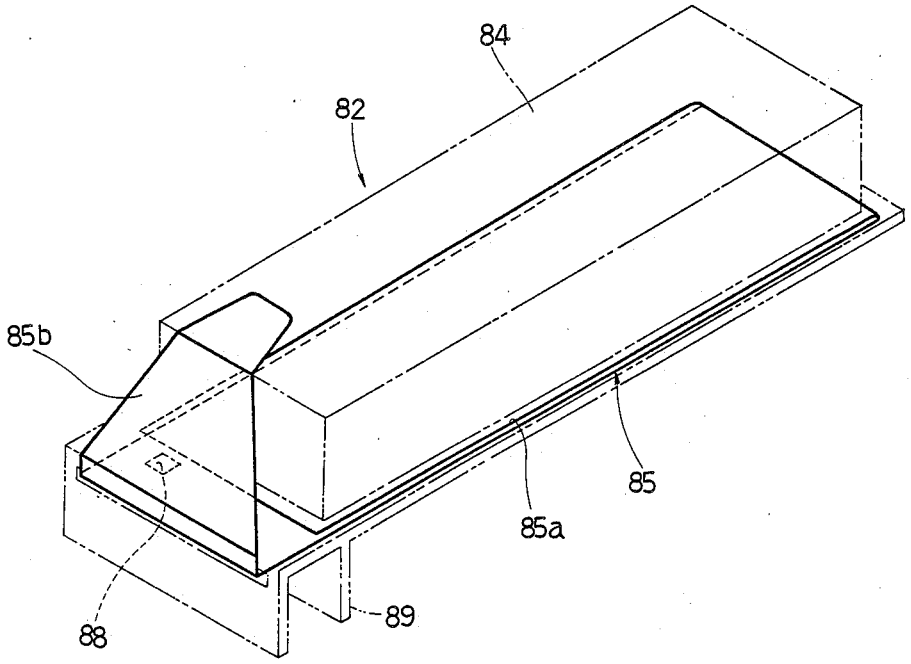

In the following, this embodiment is described in conjunction with accompanying drawings:

FIG. 19 is a schematic longitudinal sectional side view of a toner supplementing device showing the state of a hopper 81 of a developing equipment in a copier loaded with a cartridge 82 by inserting it thereinto from above.

Figure 21:
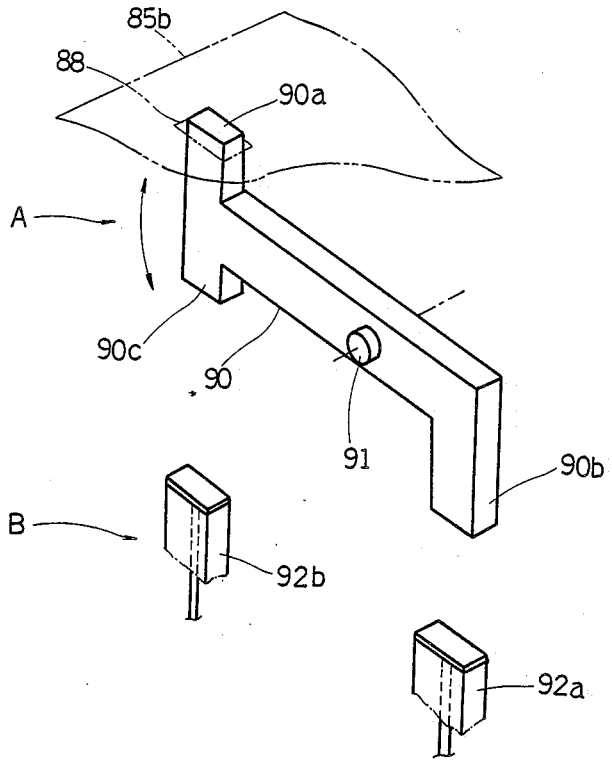
Figure 22:
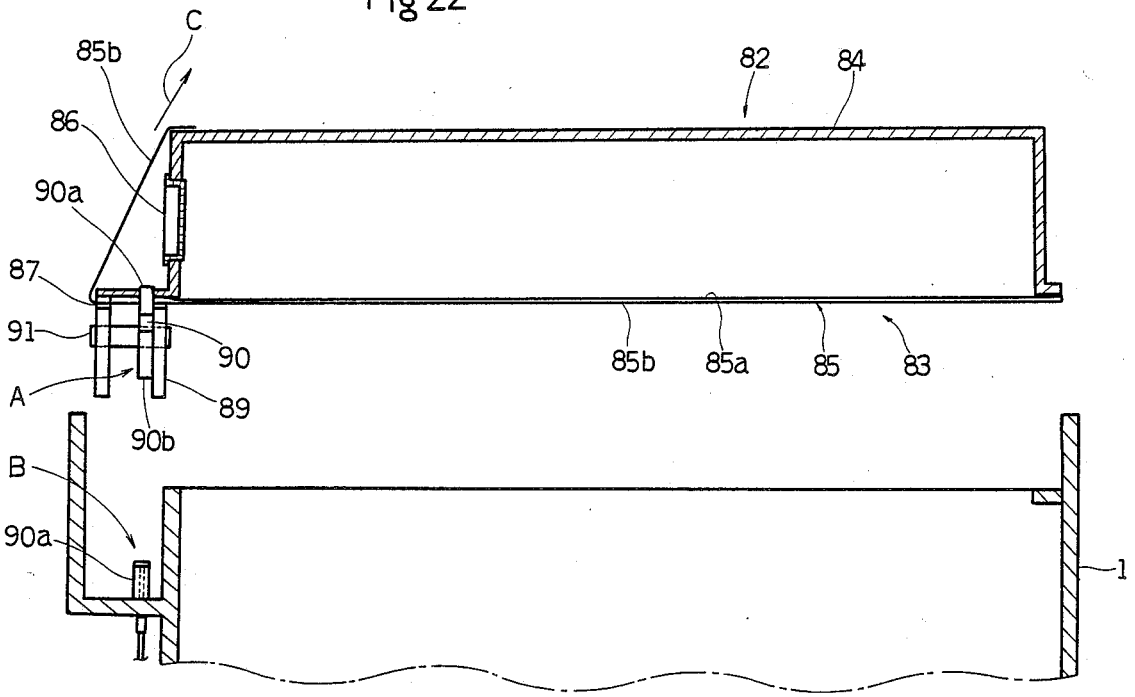

The aforementioned cartridge 82 comprises, as shown in FIGS. 20 through 23, a cartridge proper 84 having a toner supplementing port 83 (FIG. 22) at the bottom and a flexible sheet 85 folded in two plies for sealing the aforementioned toner supplementing port 83 (forming a portion 85*a* stuck on the rim of the toner supplementing port 83 and a turned-up portion 85*b* for unsealing operation) The flexible sheet 85 is composed that the toner supplementing port 83 may be unsealed by stripping off the flexible sheet 85 by pulling its turned-up portion 85*b* in the arrow mark direction C (FIG. 22).

On the aforementioned cartridge 82, there is provided a locking mechanism A for preventing the stripping of the aforementioned flexible sheet 85, and on the aforementioned hopper 81 side, an unlocking mechanism B for lifting the preventing state by means of the aforementioned locking mechanism A by loading the aforementioned cartridge 82 in the specified position. Numeral 86 designates a cap for sealing the toner filling-in port, and 87; a slit for letting the tuned- up portion 85*b* of the flexible sheet 85 pass there- through.

Details of the aforementioned locking mechanism A are as follows:

Thus, as shown in FIG. 21, a small hole 88 is formed in the turned-up portion 85*b* of the flexible sheet 85. On the other hand, on a bracket 89 (FIG. 22) provided at the front end side bottom portion of the cartridge proper 84, a swingable lever 90 made of a highly conductive material such as metal, etc., which exemplifies the cartridge indication part, is pivotally swingably held on a horizontal shaft 91. At one end portion of the swingable lever 90, there is provided a rising portion 90*a* to be inserted in the aforementioned small hole 88. And on the other end portion, a first drooping portion 90*b* is provided.

Figure 23:
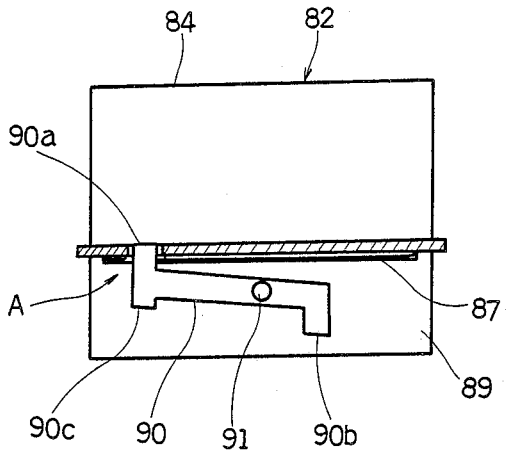

Under the normal state, the swingable lever 90 is maintained in the state of its rising portion 90*a* being inserted in the aforementioned small hole 88, as shown in FIGS. 21 and 23, by dint of its frictional resistance around the horizontal shaft 91 or by such a means as its slight adhesion on the bracket 89, such that the stripping off of the flexible sheet 85 is prevented by the rising portion 90*a*. Identification code 90*c* designates a second drooping portion provided at one end portion of the aforementioned swingable lever 90.

Figure 24:
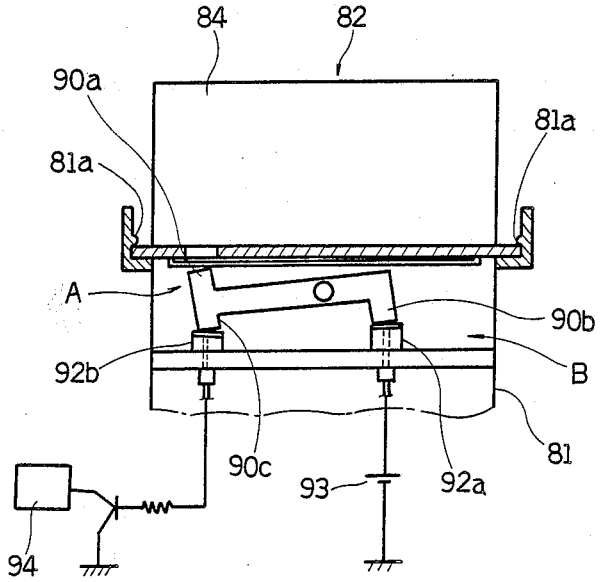

Details of the aforementioned unlocking mechanism B are as follows:

As shown in FIGS. 21, 22 and 24, on the outside part of the hopper 81, there are provided abutting members 92*a* and 92*b* having electrical contacts on their upper surfaces respectively at a position corresponding to the aforementioned first drooping portion 90*b* and at a position corresponding to the aforementioned second drooping portion 90*c*. And as the cartridge 82 is loaded into the specified position in the hopper 81, as shown in FIG. 24, the aforementioned first drooping portion 90*b* touches on the abutting member 92*a*, thereby to be thrusted up; consequently, the swingable lever 90 swings around the horizontal shaft 91, causing the rising portion 90*a* to leave from the small hole 88, thereby lifting the aforementioned preventing state.

In this unlocked state, the aforementioned second drooping portion 90*c* impinges on the other abutting member 92*b*, thereby establishing a circuit between a power source 93 and an indicator 94, whereby proper loading of the cartridge 82 is indicated by this indicator 94.

Identification code 81*a* in FIG. 24 is an engaging protrusion for preventing floating-up of the cartridge by its elastic fit with a flange portion of the cartridge proper 84.

The copier may be composed in such a way that the copying operation can not be performed, unless the cartridge 82 has not been loaded correctly, with a switch for checking the copying operation is installed in place of the indicator 94. The position of the afore-mentioned first drooping portion 90*b* (the length from the swinging center of the swingable lever 90) and the position of the abutting member 92*a* are preset type by type of the copier or the toner to be housed in the cartridge.

Figure 25:
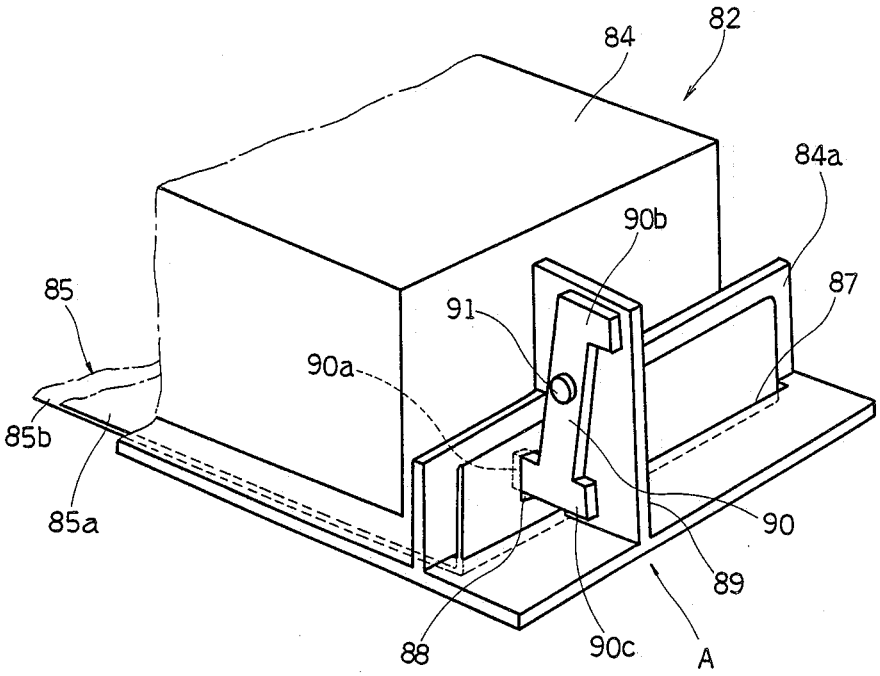
Figure 26:
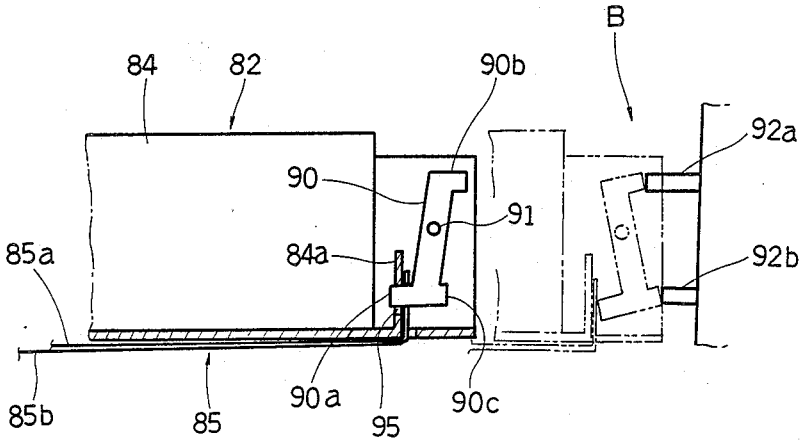

FIGS. 25 and 26 give an alternative embodiment. This embodiment is characterized in that there is provided a locking mechanism A of a similar composition as the aforementioned forward, as seen in the inserting direction of the cartridge 82 which is so composed being loading in the horizontal direction toward the hopper 81. At this embodiment not only a small hole 88 is formed in each of the flexible sheets 85 at the portion where such two sheets are plied, but a small hole 95 is also formed in the longitudinal plate part 84*a* which supports this two-ply sheets, to let the rising portion 90*a* of the swinging lever 90 fit into these small holes 88, 95. Other composition and action are substantially same as in the aforementioned embodiment; therefore, the explanation is omitted, with the same codes attached to the same components.

It should be noted also that both in the above-mentioned embodiments, a second drooping portion 90*c* and the abutting member 92*b* corresponding thereto are provided, but they may be omitted.

This embodiment, being of such a composition as hereabove-described, is able to attain the following effect:

Unless the cartridge 82 is properly loaded, the preventing state effected by means of the locking mechanism A can not be unlocked; therefore, the flexible sheet 85 can not be stripped off.

Accordingly, the toner supplementing port 83 will never be unsealed carelessly, while the loading of the cartridge 82 is imperfect, thereby foreclosing scattering of toner to the outside.

Even when the cartridges 82 are formed in a specified size, so that their component parts may be commonly used in a plurality of types of copiers, etc., it is possible to make judgement on whether a cartridge 82 is matched to the machine type by individually presetting the positional relation in each machine type between a locking mechanism A provided beforehand on the cartridge 82 and the unlocking mechanism B provided on the hopper side; accordingly, mingling of different types of toners is preventable, even if a cartridge 82 not matched to the machine type has been loaded.

What is claimed is:

1. A cartridge discriminating system in which while a cartridge indicating means is provided on a part of a toner housing cartridge, an indication detecting means for detecting the aforementioned cartridge indicating means is provided on the image forming apparatus proper side, so that the suitability of the type or position of the cartridge inserted is detected by detecting the cartridge indicating means by the aforementioned detecting means, when the cartridge has been inserted into the cartridge inserting part of the image forming apparatus proper and wherein the cartridge indicating means is a magnetic card and the cartridge indication detecting means is a magnetic head.

2. A cartridge discriminating system in which while a cartridge indicating means is provided on a part of a toner housing cartridge, an indication detecting means for detecting the aforementioned cartridge indicating means is provided on the image forming apparatus proper side, so that the suitability of the type or position of the cartridge inserted is detected by detecting the cartridge indicating means by the aforementioned detecting means, when the cartridge has been inserted into the cartridge inserting part of the image forming apparatus proper and wherein the cartridge indicating means is a small container housing a developer of the same type as the toner and the carrier housed in the cartridge and the indication detecting means is a permeability sensor.

3. A cartridge discriminating system in which while a cartridge indicating means is provided on a part of a toner housing cartridge, an indication detecting means for detecting the aforementioned cartridge indicating means is provided on the image forming apparatus proper side, so that the suitability of the type or position of the cartridge inserted is detected by detecting the cartridge indicating means by the aforementioned detecting means, when the cartridge has been inserted into the cartridge inserting part of the image forming apparatus proper and wherein the cartridge indicating means is an IC card and the indication detecting means is an analyzer.

4. A cartridge discriminating system in which while a cartridge indicating means is provided on a part of a toner housing cartridge, an indicating detecting device for detecting the aforementioned cartridge indicating means is provided on the image forming apparatus proper side, so that the suitability of the type or position of the cartridge inserted is detected by detecting the cartridge indicating means by the aforementioned detecting means, when the cartridge has been inserted into the cartridge inserting part of the image forming apparatus proper and wherein the cartridge indicating means is a pattern printed on said cartridge, the indication detecting means is an optical sensor for detecting said pattern, and said pattern printed on said cartridge is a logo mark indicating the maker of the cartridge.

5. A toner housing cartridge equipped with a hollow container for housing powder toner and a cartridge indicating means for indicating the type or position of the cartridge, which is installed on a part of the hollow container and wherein the cartridge indicating means is a magnetic card.

6. A toner housing cartridge equipped with a hollow container for housing powder toner and a cartridge indicating means for indicating the type or position of the cartridge, which is installed on a part of the hollow container and wherein the cartridge indicating means is an IC card.

7. An image forming apparatus of a design such that an indication detecting means for detecting the type or position of the cartridge is provided in the cartridge inserting part of the image forming apparatus proper and the aforementioned detecting means detects the suitability of the type or position of the cartridge inserted and wherein the indication detecting means is a permeability sensor.

8. A cartridge discriminating system of a design such that while a cartridge indicating means is provided on a part of a toner housing cartridge, an indication detecting means for detecting the aforementioned cartridge indicating means and a cartridge insertion preventing means which prevents complete insertion of cartridge are provided on the cartridge inserting part on the image forming apparatus proper side, so that when the cartridge is inserted in the cartridge inserting part of the image forming apparatus proper, the suitability of the type of the cartridge inserted is checked by the aforementioned indication detecting means and only when proper cartridge has been inserted, the aforementioned cartridge insertion preventing means is unlocked, thereby permitting complete insertion of the cartridge.

9. A cartridge discriminating system of a design such that while a cartridge indicating means is provided on a part of a toner housing cartridge, an indication detection means for detecting the aforementioned cartridge indicating means and a cartridge insertion preventing means for preventing complete insertion of the cartridge are provided on the cartridge inserting part on the image forming apparatus proper side and, further, a reference indication storing means capable of storing the item to be stored corresponding to the item indicated of the aforementioned cartridge indicating means as well as freely updating the pertinent stored item is provided on the image forming apparatus proper side, so that when the cartridge is inserted into the cartridge inserting part of the image forming apparatus proper, the suitability of the type of the inserted cartridge may be checked by comparing the indication data detected by the aforementioned indication detecting means with the stored item of the reference indication storing means; then, only when proper cartridge has been inserted, the aforementioned cartridge insertion preventing means is unlocked, thereby permitting complete insertion of the cartridge.

10. A cartridge discriminating system for an image forming apparatus comprising the image forming apparatus replaceably equipped with a developing machine for developing static latent image by supplying toner to photoreceptor, wherein while a cartridge indicating means is provided on a part of a toner housing cartridge, a developing machine indicating means is provided on a part of the developing machine and not only an indication detecting means for detecting the physical signal from the aforementioned cartridge indicating means, but a developing machine detecting means for detecting the aforementioned developing machine, when the aforementioned developing machine is attached to the image forming apparatus proper, are provided on the image forming apparatus proper side, so that when the cartridge is inserted into the cartridge inserting part of the image forming apparatus proper, the suitability of the type of the cartridge inserted is checked by comparing the indication item detected by the aforementioned indication detecting means with the data detected by the developing machine detecting means.

11. A cartridge discriminating system for an image forming apparatus provided with a toner housing cartridge of a composition such that the toner supplementing port is sealed with a flexible sheet folded in two plies and the toner supplementing port is sealed with a flexible sheet felded in two plies and the toner supplementing port is unsealed by stripping off the flexible sheet by pulling the turned-up portion of said flexible sheet, in which while a swingable lever form indication part for preventing stripping of the aforementioned flexible sheet is prvoded on a part of the toner housing cartridge, an indication detecting means for unlocking the stripping preventing state set by means of the swingable lever form indication part by loading the aforementioned cartridge in its specified position is provided on the cartridge inserting part on the image forming apparatus proper side.

* * * * *